US009126737B2

(12) United States Patent
Pickering

(10) Patent No.: US 9,126,737 B2
(45) Date of Patent: Sep. 8, 2015

(54) TORSO-SHAPED STORAGE DEVICE

(71) Applicant: Druantia Innovation LLC, Chicago, IL (US)

(72) Inventor: Martyn Pickering, Chicago, IL (US)

(73) Assignee: Druantia Innovation LLC, Chicago, IL (US)

( * ) Notice: Subject to any disclaimer, the term of this patent is extended or adjusted under 35 U.S.C. 154(b) by 212 days.

(21) Appl. No.: 13/790,449

(22) Filed: Mar. 8, 2013

(65) Prior Publication Data

US 2013/0256174 A1 Oct. 3, 2013

Related U.S. Application Data

(60) Provisional application No. 61/608,460, filed on Mar. 8, 2012.

(51) Int. Cl.
*B65D 85/00* (2006.01)
*B65D 81/36* (2006.01)

(52) U.S. Cl.
CPC ..... *B65D 85/00* (2013.01); *B65D 81/365* (2013.01)

(58) Field of Classification Search
CPC ..... B65D 81/365; B65D 85/18; A47F 8/00; A47F 8/02; A45G 25/00; A45G 25/16; A45G 25/28
USPC ..... 206/457, 216; 211/85.7, 85.3
See application file for complete search history.

(56) References Cited

U.S. PATENT DOCUMENTS

| | | | | | |
|---|---|---|---|---|---|
| 2,666,560 | A | * | 1/1954 | Wexler et al. | 223/68 |
| 2,702,148 | A | * | 2/1955 | Paasche | 223/68 |
| 3,330,452 | A | * | 7/1967 | Henderson | 223/68 |
| D272,328 | S | | 1/1984 | Breyer | |
| 4,545,514 | A | * | 10/1985 | Toy | 223/66 |
| 4,739,911 | A | | 4/1988 | Quinn | |
| 4,805,816 | A | | 2/1989 | Freund | |
| 5,137,158 | A | * | 8/1992 | Brockway | 211/106.01 |
| 5,244,131 | A | * | 9/1993 | Hollingsworth | 223/85 |
| 5,265,779 | A | * | 11/1993 | Jiang | 223/68 |
| 5,310,099 | A | * | 5/1994 | Claas | 223/66 |
| 5,649,651 | A | | 7/1997 | Lam | |
| 5,791,475 | A | * | 8/1998 | Pichardo | 206/457 |
| D399,052 | S | | 10/1998 | Fritsche | |
| D408,131 | S | | 4/1999 | Fritsche | |
| 5,938,088 | A | | 8/1999 | Lam | |
| 6,070,720 | A | | 6/2000 | Johnson | |
| 6,073,783 | A | * | 6/2000 | Allman | 211/85.3 |
| D484,434 | S | | 12/2003 | Andrys | |
| 7,168,263 | B1 | * | 1/2007 | Zenner | 62/457.1 |
| 7,740,215 | B2 | | 6/2010 | Lang | |

(Continued)

OTHER PUBLICATIONS http://penalty.en.alibaba.com/productgrouplist-213494460/Mini_Jersey.html, Mini Jersey, Feb. 28, 2014.

(Continued)

*Primary Examiner* — Steven A. Reynolds

(57) ABSTRACT

A three-dimensional torso-shaped storage device having a fabric cover in the appearance of a sports jersey being worn on a torso. A frame portion made up of an upper body piece and lower body piece provides a compartment and supports the cover. The lower body piece may be hinged to open at a base of the device to provide access to the compartment. An object retention member may be slidably attached to the frame portion to retain an object in the compartment.

15 Claims, 16 Drawing Sheets

(56) References Cited

U.S. PATENT DOCUMENTS

| | | | | |
|---|---|---|---|---|
| 2002/0011502 | A1 | 1/2002 | Preyss | |
| 2003/0146250 | A1* | 8/2003 | Dudley | 223/66 |
| 2004/0074124 | A1 | 4/2004 | Andrys | |
| 2005/0188570 | A1 | 9/2005 | Andrys | |
| 2006/0054576 | A1* | 3/2006 | Durham | 211/85.7 |
| 2007/0102383 | A1* | 5/2007 | Evans et al. | 211/85.7 |
| 2007/0278365 | A1 | 12/2007 | Jackson | |
| 2009/0071922 | A1* | 3/2009 | Barra | 211/85.3 |
| 2009/0250562 | A1 | 10/2009 | Juptiz | |
| 2011/0101015 | A1* | 5/2011 | Bollmus et al. | 221/1 |

OTHER PUBLICATIONS http://www.alibaba.com/promotion_car-mini-jersey-promotion-list.html, Car Mini Jersey Promotion, Feb. 28, 2014.
http://www.aliexpress.com/store/product/Mini-Kit-Spain-Barca-FC-Soccer-Sports-Jersey-Car-Window-Suction-Cup/733108_974396020.html, Feb. 28, 2014.
http://www.alibaba.com/product-detail/2014-Hot-selling-Mini-football-jersey_944731838.html, 2014 Hot Selling Mini Football Jersey, Feb. 28, 2014.
Image of Burger King packaging for NFL mini jersey promotion.

* cited by examiner

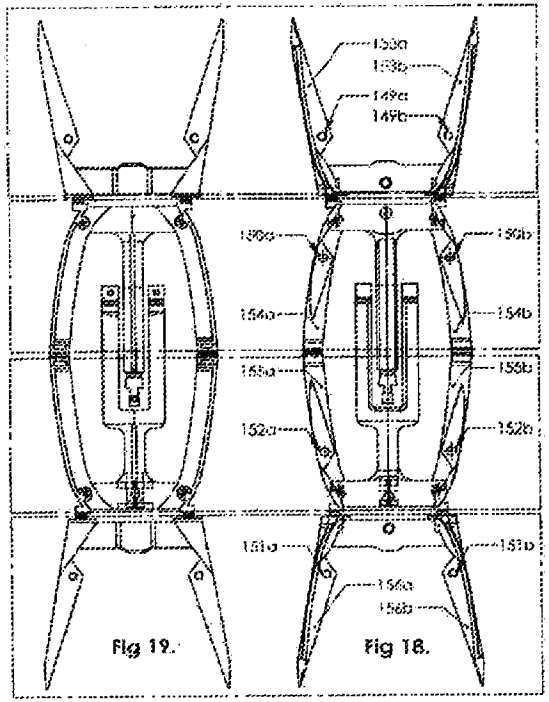
Fig 18.
Fig 19.
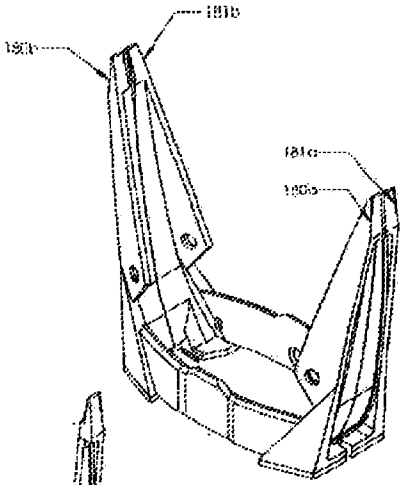
Fig 20.
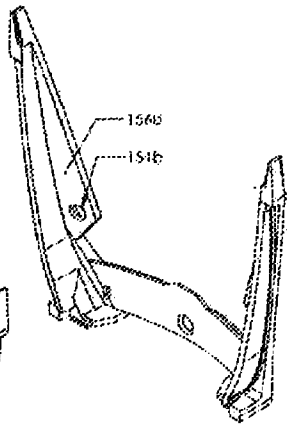
Fig 21a.
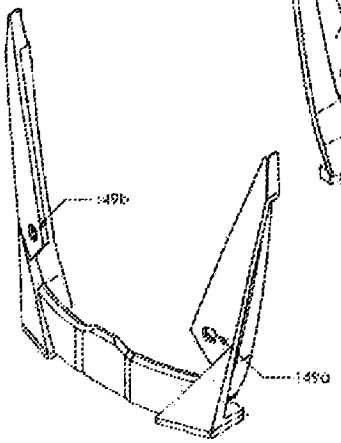
Fig 21b.

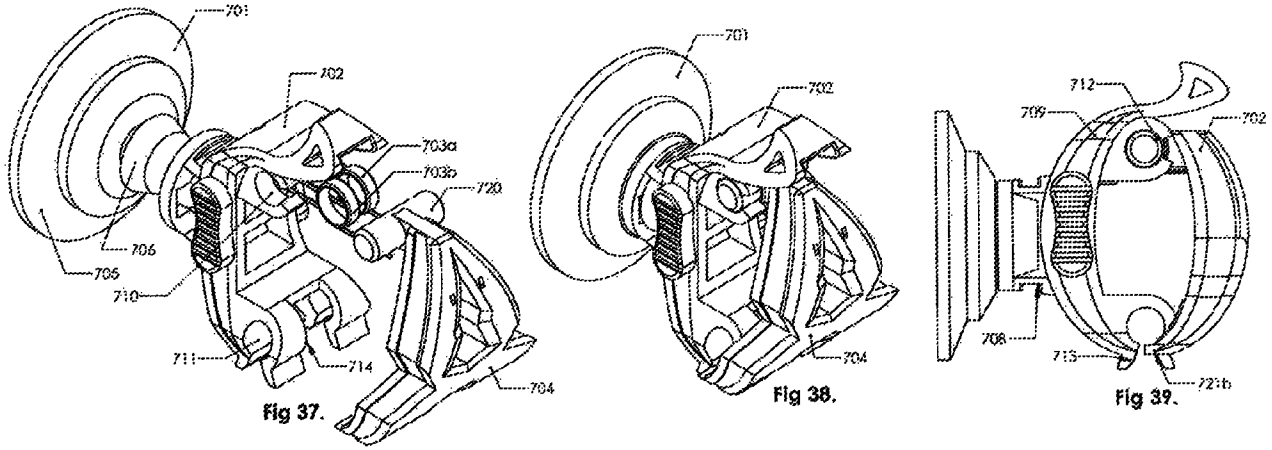
Fig 37.
Fig 38.
Fig 39.
Fig 40.
Fig 41.
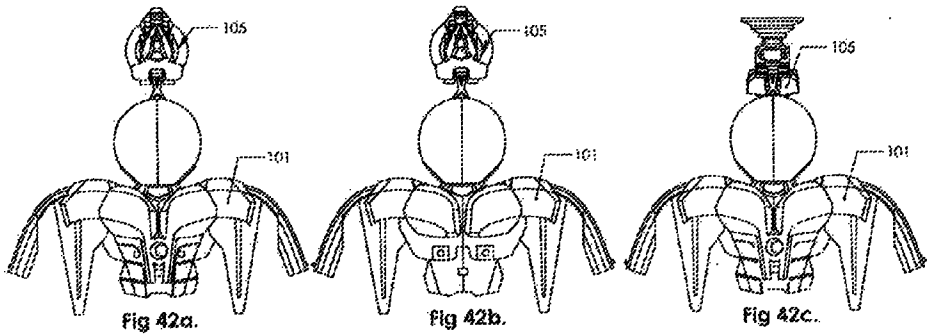
Fig 42a.
Fig 42b.
Fig 42c.

TORSO-SHAPED STORAGE DEVICE

This is a non-provisional patent application claiming priority to U.S. Provisional Application Ser. No. 61/608,480, filed Mar. 8, 2012, which is herein incorporated by reference in its entirety.

BACKGROUND AND SUMMARY OF THE INVENTION

This application discloses a three dimensional torso shaped storage device having a fabric cover in the appearance of a sports jersey being worn on a torso. The device is both an aesthetically appealing miniaturized jersey and a functional storage container. Thus, users can both display the device and utilize it to store various items. For example, in certain embodiments the sports jersey is designed to approximate the jerseys of professional, collegiate or local football, soccer or hockey teams, thus appealing to sports fans. The device may be hung from a golf bag, desk, rear-view mirror, window, gym bag, backpack, etc. to show the user's support of or enthusiasm for his or her preferred team.

In addition to its aesthetic appeal, the device functions as a storage container. The device has a frame forming a hollow interior in which items can be stored. The frame supports and is covered by a jersey shaped cover, thereby forming a storage compartment within the frame. The base of the device has an opening in the base of the torso to provide access to the storage compartment. The storage compartment is adapted to receive and store various objects such as credit cards, garage door remotes, golf tools, note pads, air fresheners, etc, which users can readily access.

In certain embodiments, the lower portion of the device is hinged at the sides so that the opening at the base of the device can be expanded to help users access the storage compartment. In addition, in certain embodiments, an object retention member, which is slidably attached to the frame, supports the retained object within the compartment. When the user wants to access the object, they can slide the object retention member downward, thereby extracting the object held by the object retention member out of the compartment.

As described in detail below, the design of the device and its components provide an easily assembled and appealing storage device. Through the use of strategic design, the device has a minimal number of components. These design features reduce the manufacturing assembly costs, thereby making the product affordable, yet functional and aesthetically appealing.

The specific components and design of the device is described in detail below.

BRIEF DESCRIPTION OF THE DRAWINGS

FIG. 18 is a top view of the lower body piece of FIG. 11 showing the subportions.

FIG. 19 is a bottom view of the lower body piece of FIG. 11 showing the subportions.

FIG. 20 is a perspective view of the first and fourth subportions of the lower body piece of FIG. 11, showing the second and third subportions removed for clarity.

FIG. 21 is a perspective view of the first and forth subportions of the lower body piece of FIG. 11, showing the second and third subportions removed for clarity and the first and fourth subportions separated for clarity.

FIG. 37 is a perspective exploded view of an attachment device of the device of FIG. 1A.

FIG. 38 is a perspective view of an attachment device of the device of FIG. 37.

FIG. 39 is a side view of an attachment device of the device of FIG. 37.

FIG. 40 is a back view of an attachment device of the device of FIG. 37.

FIG. 41 is a front view of a portion of the attachment device of the device of FIG. 37.

FIG. 42A-C shows the flexibility/range of an attachment device according to the present invention, illustrating the reversible nature and pivot capabilities to the main body portion of device of FIG. 1A.

DETAILED DESCRIPTION

Figure 1B:
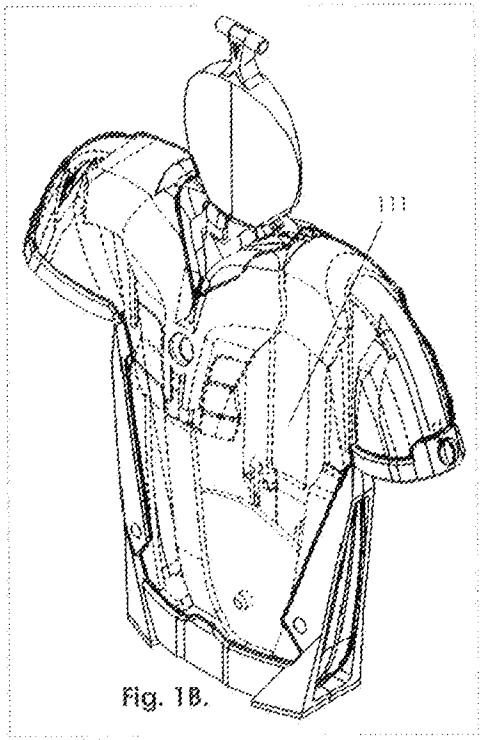
FIG. 1B is a perspective view of the storage device of FIG. 1A with the components positioned beneath the cover shown as dashed lines.
Figure 1A:
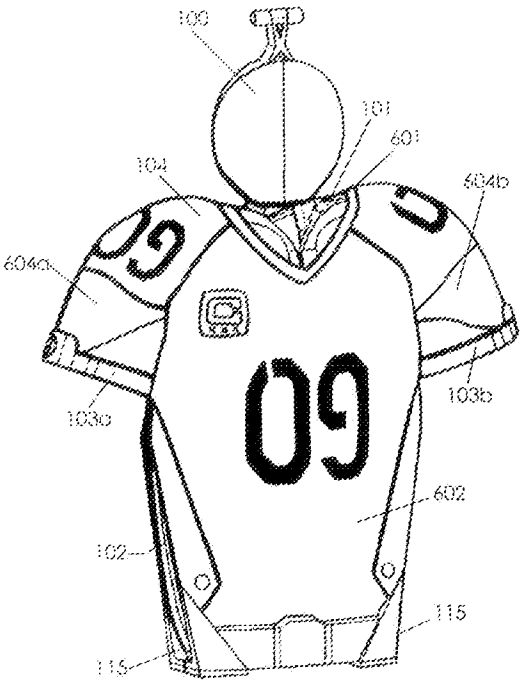
FIG. 1A is a perspective view of an embodiment of a storage device, having an object retention arm, according to the present invention.
Figure 2:
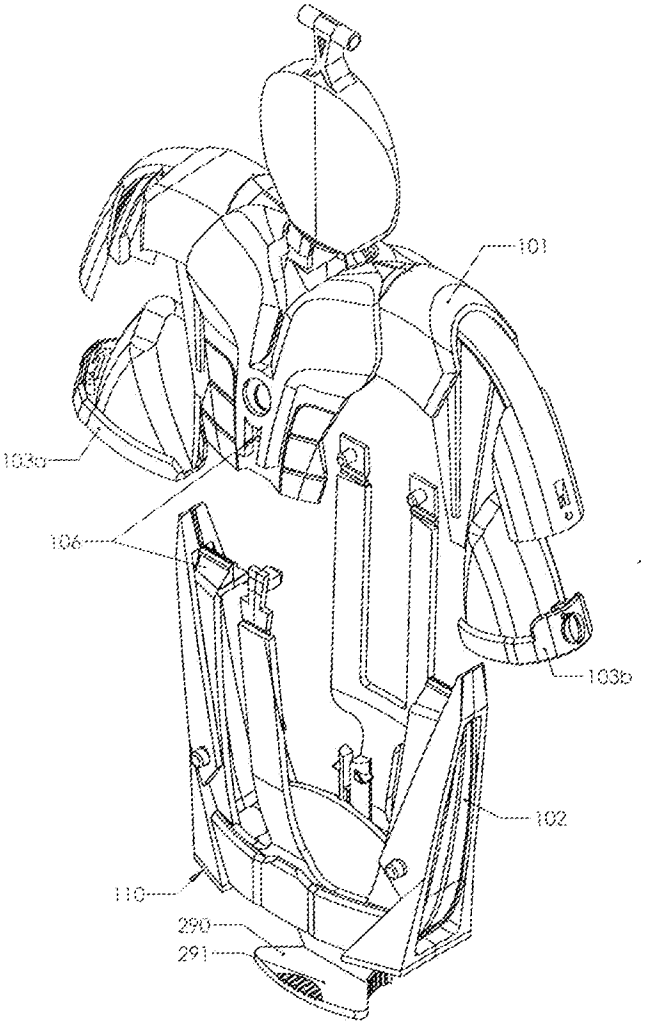
FIG. 2 is an exploded perspective view of the storage device of FIG. 1A, with the cover removed to display other components more clearly.
Figure 3:
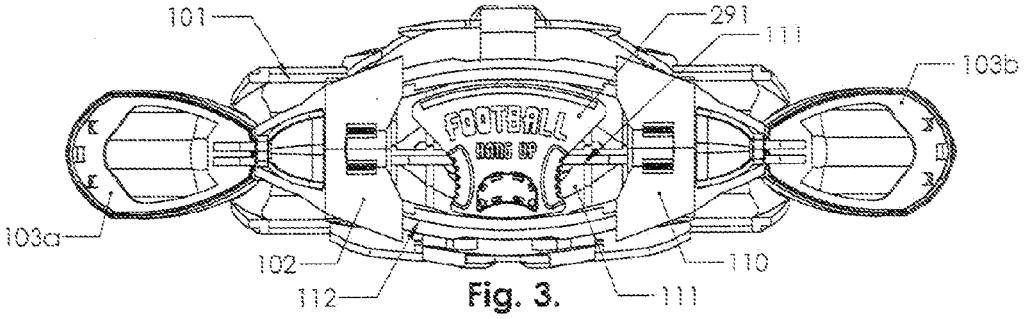
FIG. 3 is a bottom view of the storage device of FIG. 1A, with the cover removed.
Figure 4:
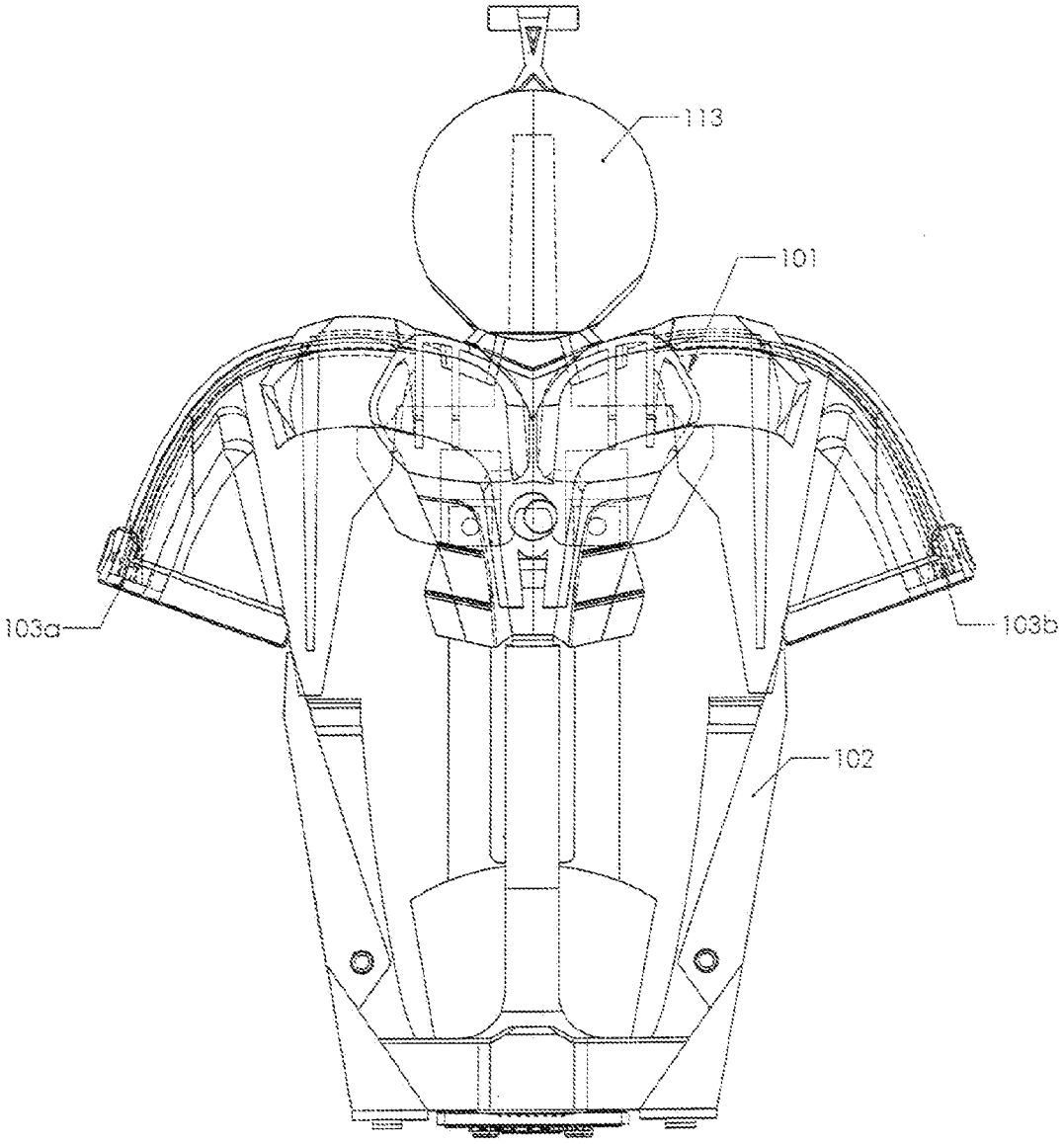
FIG. 4 is a front view of the storage device of FIG. 1A, with the cover removed.

FIGS. 1A-4 display an embodiment of a torso shaped storage device 100. As shown in FIGS. 1A and 1B, this embodiment generally has the form of a three dimensional human torso covered by a short sleeved jersey. The device of this embodiment has a frame portion 106, which supports a cover 104. Further details regarding these components are set forth below.

Frame portion 106 is made up of an upper body piece 101 and lower body piece 102, which are connected to one another. In this embodiment, upper body piece 101 generally corresponds to the upper chest and shoulder portion of the torso shape. Upper body piece further has a head portion 113 that is not covered by the cover 104.

Lower body piece 102 generally has the form of and corresponds to the lower and abdominal and lower back portion of the torso shape. As shown in FIG. 1A, certain portions of lower body piece 102 are not covered by the cover 104. Those portions form an exterior portion of the sides of the torso shape. Further details of the upper body piece 101 and lower body piece 102 are set forth below.

Device 100 has an open interior portion or compartment 111 defied by the frame and, in part, the cover. Compartment 111 is sized to be able to receive a variety of objects, including for example, credit cards, fragrance, cigars, golf tees, adhesive notes, and divot tools, microfiber cloth, tissues, etc. which a user can store inside of device 100 and remove when needed. Device 100 also has a base 110 at the bottom of the "torso" shape. The base 110 of the device defines an opening 112 which permits users to access compartment 111 and place objects into and remove objects from compartment 111.

In this embodiment the closing members are magnets 115, which allow the second and third subportions to be closed and reopened repeatedly, thereby allowing the user to increase the opening at the base of the device to access stored objects. The object retention member 290 in this embodiment is slidably attached to lower body piece 102. Object retention member 290 has a base 291, which support an object and helps retain the object inside of the compartment 211. Further details of this selected embodiment, including the magnets and object retention member are detailed later.

As shown in FIG. 1A cover 104 has the appearance of a short sleeved shirt or jersey. Cover 104 has an opening 601, which serves as a neck hole, through which the head portion 113 of the upper body piece extends. Cover 104 further has a front 602 and a back (not shown in FIG. 1A). Cover 104 further has a first sleeve portion 604*a* and a second sleeve portion 604*b*, which have openings at the ends of the sleeve portions. Cover 104 is a flexible material, may be a fabric. Further details regarding the manufacturing and assembly of the cover 104 are set forth below.

Figure 71:
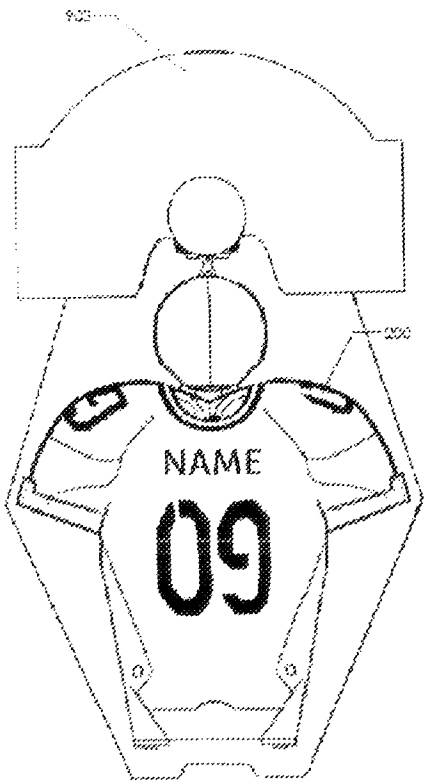
FIG. 71 is a rear perspective view of the device of FIG. 1A with the attachment device of FIG. 37 and the packaging of FIG. 60.
Figure 70:
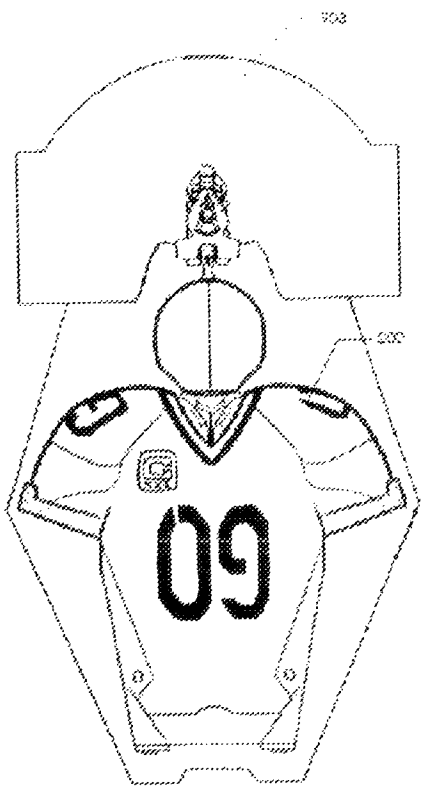
FIG. 70 is a front perspective view of the device of FIG. 1A with the attachment device of FIG. 37 and the packaging of FIG. 60.
Figure 69:
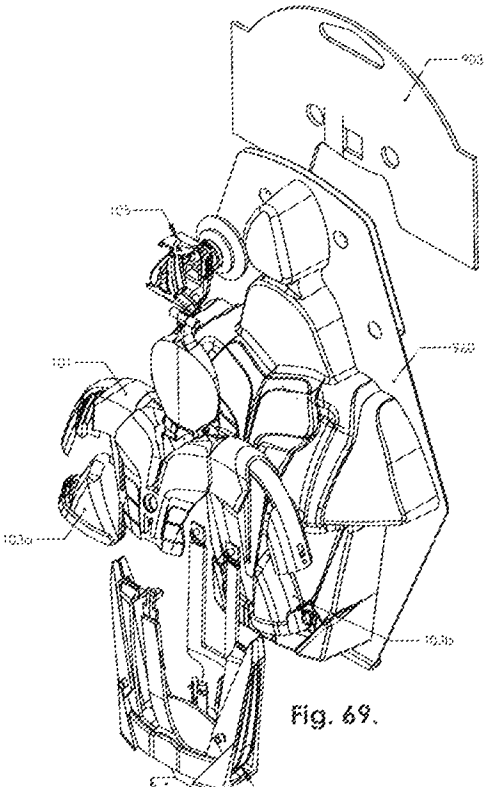
FIG. 69 is an exploded perspective view of the device of FIG. 1A with the attachment device of FIG. 37 and the packaging of FIG. 60.

A pair of arm caps 103*a* and 103*b* are attached to frame portion 106. A portion of cover 104 is retained between arm caps 103*a* and 103*b*. This embodiment further includes an attachment device 105, (not shown in FIG. 1A, shown in FIGS. 70 and 71) as a clip, which is rotatably connected to frame portion 106.

Details of upper body piece 101 are shown in FIGS. 5-10. As previously described, upper body piece 101 comprises part of frame 106. Head portion 113 is positioned at the top of the upper body piece 101. Head portion 113 is a generally circular when viewed from the front to approximate the shape of a human head or helmet. Head portion 113 has a front surface 114 and back surface 115, which are slightly curved, yet flat enough to allow a two dimensional sticker or decal to be applied to the surface without wrinkling or air bubbles. Such stickers or decals may display the helmet or team colors of a sports team. While the front and back surfaces are slightly curved to provide a three dimensional appearance to the head portion, it is contemplated that these surfaces could be flat. Alternatively, head portion 113 could be a variety of shapes.

Upper body piece 101 further has an attachment device mating member 116. As shown in this embodiment, attachment device mating member has a pivot pin 117. Pivot pin 117 has an axis generally horizontal and generally in the same plane as the head portion 113. Attachment device mating member 116 also has a connector 118 that attaches pivot pin 117 to the head portion 113.

Figures 5, 6, 7, 8, 9, 10:
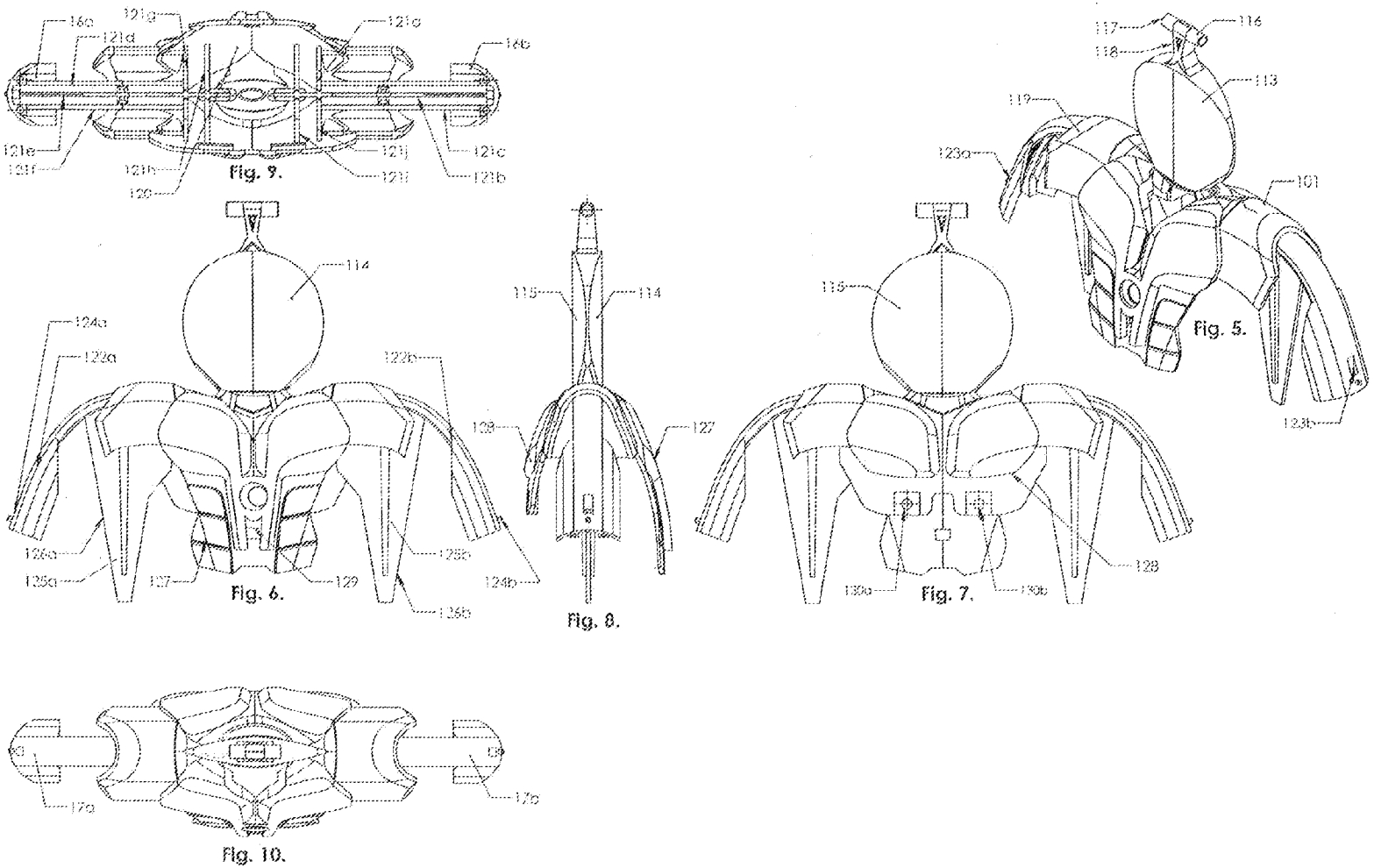
FIG. 5 is a perspective view of the upper body piece of the storage device of FIG. 1A.
FIG. 6 is a front view of the view of the upper body piece of the storage device of FIG. 1A.
FIG. 7 is a back view of the view of the upper body piece of the storage device of FIG. 1A.
FIG. 8 is a side view of the view of the upper body piece of the storage device of FIG. 1A.
FIG. 9 is a bottom view of the view of the upper body piece of the storage device of FIG. 1A.
FIG. 10 is a top view of the view of the upper body piece of the storage device of FIG. 1A.
Figure 11:
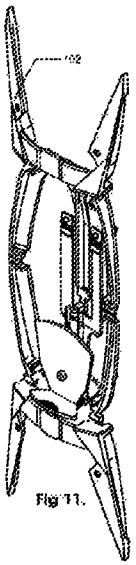
FIG. 11 is a perspective view of the lower body piece of the device of FIG. 1A prior to subassembly.

Upper body piece 101 has an exterior surface 119 and an interior surface 120 (shown in FIGS. 5 & 9). Portions of exterior surface 119 are comprised of interconnecting curves and planes approximating a muscular upper torso/and/or shoulder pads worn in various sports such as football. Interior surface 120 defines part of compartment 111. Interior surface 120 includes a plurality of ribs 121*a-j* (shown in FIG. 9), providing structural rigidity to the upper body piece.

Upper body piece 101 has a first shoulder extension 122*a* and a second shoulder extension 122*b* opposite the first shoulder extension. First and second shoulder extensions 122*a* and 122*b* extend outward to form a portion of the upper arm of the torso. The first shoulder extension has an interior surface 16*a* and an exterior surface 17*a*. Similarly, the second shoulder extension has an interior surface 16*b* and an exterior surface 17*b*.

First shoulder extension 122*a* has a first shoulder extension mating member 123*a*. Similarly, second shoulder extension 122*b* has a second shoulder extension mating member 123*a* and 123*b*. First and second shoulder extension mating members 123*a* and 123*b* correspond to and mate to mating features on arm caps 103*a* and 103*b* respectively, which are described below in more detail, to attach arm caps 103*a* and 103*b* to the upper body piece 101. In this embodiment, the first and second shoulder extension mating members 123*a* and 123*b* are openings comprising the female portion of a snap fit. As shown in FIG. 6, in this embodiment a first guide pin hole 124*a* and second guide pin hole 124*b* extend upward into the first and second shoulder extensions 122*a* and 122*b*, respectively, to assist in alignment of the arm caps to the upper body piece.

Upper body piece 101 further has a first and second side extension 125*a* and 125*b*, respectively. First side extension 125*a* and second side extension 125*b* each extend downward from the interior surface 120. Each of the first and second side extensions has an outer edge 126*a* and 126*b* respectively, which tapers inward towards a center line of the device as the outer edge 126*a* and 126*b* extends downward. As described in further detail below, first and second side extensions 125*a* and 125*b* support the cover 104 at the sides of the torso shape and also provide support for arm caps 103*a* and 103*b*.

Upper body piece 101 further has a chest portion 127 and a back portion 128 opposite the chest portion. Chest portion 127 generally forms the front chest portion of the torso shape. Back portion 128 generally forms the upper back portion of the torso shape. Chest portion 127 has chest portion mating feature 129 for mating the upper body piece 101 with the lower body piece 102. Similarly, back portion 128 has a pair of back portion mating features 130*a* and 130*b* for mating the upper body piece 101 with the lower body piece 102. As shown in this embodiment, chest portion mating feature 129 and back portion mating features 130*a* and 130*b* are openings. These openings serve as a female portion of a cantilever beam type snap fit. It should be appreciated by one of ordinary skill in the art that other mating features may be used.

In one embodiment, upper body piece is an injection molded component made of glass filled nylon. However, it will be understood by those of skill in the art that any sufficiently rigid material could be used.

Figure 12:
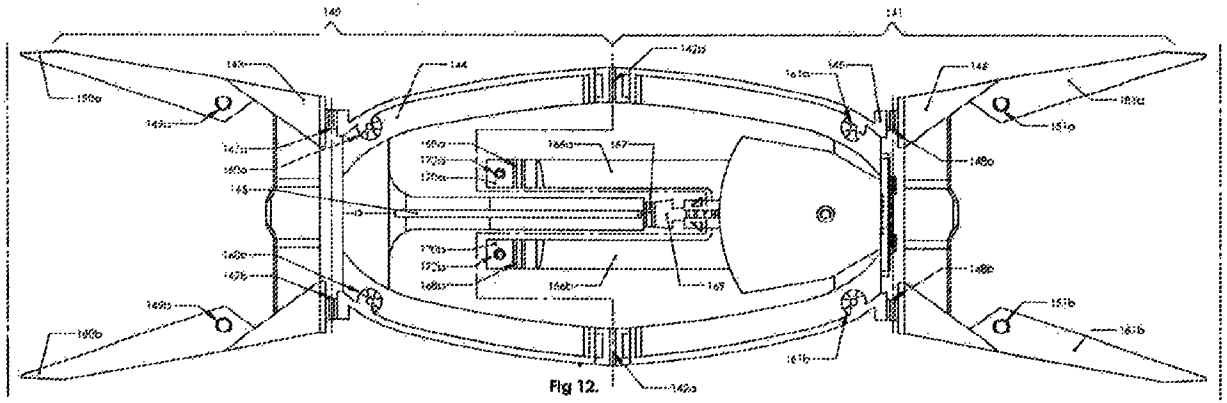
FIG. 12 is a top view of the lower body piece of FIG. 11 prior to subassembly.
Figure 13:
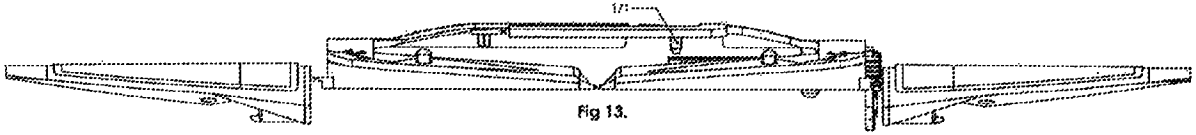
FIG. 13 is a side view of the lower body piece of FIG. 11 prior to subassembly.

Details of lower body piece 102 are shown in FIGS. 11-24. As shown in FIG. 12, lower body piece 102 has two portions, a first portion 140 and a second portion 141. First portion 140 generally corresponds to the front half of the lower body piece 102 and second portion 141 generally corresponds to the back half of the lower body piece 102. As shown in this embodiment, first portion 140 and second portion 141 are connected by a first and second living hinge 142*a* and 142*b*, respectively.

First portion 140 and second portion 141 each have two subportions. Specifically, first portion 140 has a first subportion 143 and a second subportion 144, which are connected to one another via living hinges 147*a* and 148*a*. Similarly, the second portion 141 has a third subportion 145 and a fourth subportion 146, which are connected to one another via living hinges 148*a* and 148*b*.

The first subportion 143 has a pair of ends 180*a* and 181*a* and the second subportion has a pair of similar ends 181*a* and 181*b*. First subportion 143 also has a pair of mating features 149*a* and 149*b*, which correspond to mating features 150*a* and 150*b* on second subportion 144 (shown FIG. 14). Similarly, fourth subportion 146 has a pair of mating features 151*a* and 151*b*, which correspond to mating features 152*a* and 152*b* on third subportion 145. In this embodiment, mating features 150*a*, 150*b*, 152*a* and 152*b* are annular protrusions which snap fit to mating features 149*a*, 149*b*, 151*a* and 151*b*, respectively, which are openings. It will be understood by one of ordinary skill in the art that in other embodiments, mating features 149*a*, 149*b*, 151*a* and 151*b*, could be annular protrusions, and 150*a*, 150*b*, 152*a* and 152*b* could be openings. Alternatively, other snap fit designs or mating features, as well as a different number of and configuration of mating figures could be used.

The lower body piece 102 also has certain surfaces that retain the fabric jersey in place relative to the frame when the lower body piece is assembled. (Assembly of the lower body piece is described in detail below). Specifically, as shown in FIG. 18, surfaces 153*a* and 153*b* on the first subportion, surfaces 156*a* and 156*b* on the fourth subportion, surfaces 154*a* and 154*b* on the second subportion and surface 155*a* and 155*b* on the third subportion retain the cover as described below in more detail.

The lower body piece 102 also has closing members that retain the second subportion to the third subportion. Specifically, as shown in FIG. 12, the second subportion 144 has closing members 160*a* and 160*b*. The third subportion 145 has closing members 161*a* and 161*b*, which mate with closing members 160*a* and 160*b*.

In one embodiment, closing members 160*a* and 160*b* are openings, which receive closing members 161*a* and 161*b*, which are annular protrusions in this embodiment. In this embodiment, closing members 160*a* and 160*b* include ribs to create a crushed rib snap fit with closing members 161*a* and 161*b*, respectively. Those of skill in the art will recognize that other suitable retention means, including other snap fit designs may be utilized. In another embodiment, closing members are magnets. In such embodiments, advantageously, to maximize strength of the retention of the magnets within the lower body piece 102 and to minimize assembly effort, magnets 160*a*, 160*b*, 161*a* and 161*b* are secured to lower body piece 102 through insert molding. In particular, as shown the magnets are slightly recessed below the surface of the lower body piece 102, such that when the first portion and second portion are closed, the magnets do not actually touch each other. Thus, instead of the clang of magnet to magnet contact, the plastic of the second and third subportions of the lower body piece contact one another so that the devise closed more quietly, but still have sufficient magnetic force where the consumer can feel magnetic forces in question. In addition, as shown especially in FIGS. 23 and 24, lower body piece 102 has a plurality of grooves or small channels passing through the second subportion and third subportion adjacent magnets 160*a*, 160*b*, 161*a* and 161*b* to provide for improved magnetic field flow around the magnets. However, other attachment methods, maybe be used, be this adhesive, snap, or spring loaded.

Lower body piece 102 also has a first elongate attachment member 165 attached to and forming part of the second subportion 144. Opposite the first attachment member 165 are a second attachment member 166*a* and a third attachment member 166*b*. Each of the first, second and third attachment members, 165, 166*a* and 166*b*, have living hinges, 167, 168*a* and 168*b*, respectively, which create a hinged portion 169, 170*a* and 170*b*, respectively, of each of the attachment members, 165, 166*a* and 166*b*. Hinged portions 169, 170*a* and 170*b* each have a retention member 171, 172*a* and 172*b*, respectively.

Figure 14:
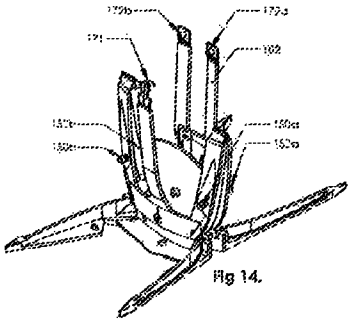
FIG. 14 is a perspective view of the lower body piece of FIG. 11 partially sub assembled.
Figure 15:
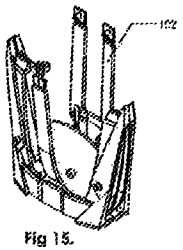
FIG. 15 is a perspective view of the lower body piece of FIG. 11 fully sub assembled.
Figure 16:
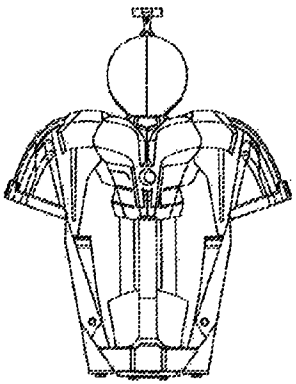
FIG. 16 is a front view of the lower body piece of FIG. 11 assembled to the upper body piece.
Figure 17:
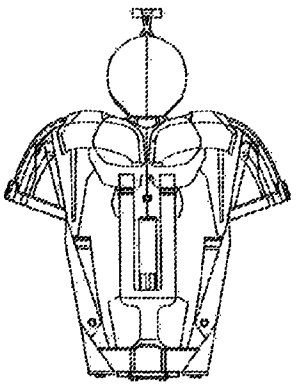
FIG. 17 is a rear view of the lower body piece of FIG. 11 assembled to the upper body piece.

Assembly of lower body piece 102 is shown in FIGS. 14-15. As shown in FIG. 14, in a first assembly step, the lower body piece is folded at living hinges 142*a* and 142*b* and closing members 160*a* and 160*b* are mated to closing members 161*a* and 161*b*, respectively to retain the second subportion 144 to the third subportion 145.

Next, the lower body piece 102 is assembled to the upper body piece 101 (not shown in FIG. 15). Retention member 171 on the lower body piece 102 connects to chest portion mating feature 129 on the upper body piece 101. Retention members 172*a* and 172*b* on the lower body piece 102 connect to back mating features 130*a* and 130*b* on the upper body piece 101 respectively, to attach the lower body piece 102 to upper body piece 101.

Cover 104 is then positioned over the upper body piece 101 and over the second subportion 144 and third subportion 145 of the lower body piece 102. Once cover is in place and positioned against surfaces 154*a* and 154*b* and 155*a* and 155*b*, the first subportion 143 is folded at hinges 147*a* and 147*b* upwards against the second subportion 144. Mating features 149*a* and 149*b* are mated to mating features 150*a* and 150*b*, thereby securing the first subportion 143 to the second subportion 144 and retaining the cover 104 between surfaces 155*a* and 156*a* and 155*b* and 156*b*. Similarly, the fourth subportion 146 is folded at hinges 148*a* and 148*b* upwards against the third subportion 145 and mating features 151*a* and 151*b* are mated to mating features 150*a* and 150*b*, thereby securing the fourth subportion 146 to the third subportion 145 and retaining the cover 104 between surfaces 153*a* and 154*a* and 153*b* and 154*b*. In this position, ends 180*a* and 180*b* are pointing upwards. When the lower body piece 102 is fully assembled, ends 180*a* and 180*b*, abut first side extension 125*a*; and ends 181*a* and 181*b* abut second side extension 125*b*, thereby providing lateral stability between the lower body piece 102 and the upper body piece 101.

In this embodiment, lower body piece is a single injection molded component made from polypropylene. However, other suitably flexible materials may be used.

Figure 22:
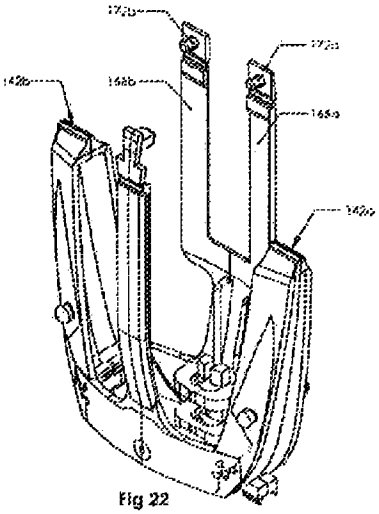
FIG. 22 is a perspective view of the lower body piece of the storage device of FIG. 1.
Figure 23:
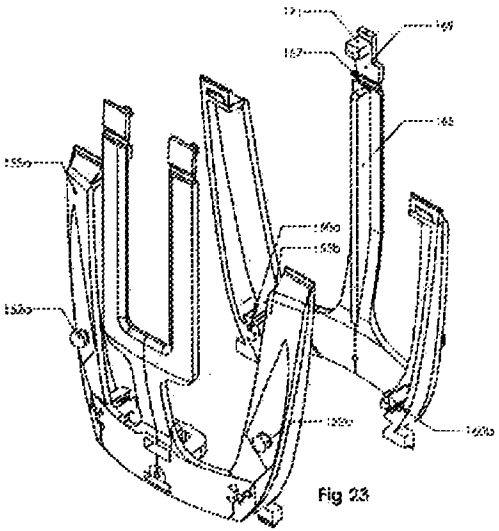
FIG. 23 is a perspective view showing the second subportion and third subportion of the lower body piece of FIG. 11, showing the second and third subportions separated for clarity and with the first and fourth subportions removed.
Figure 24:
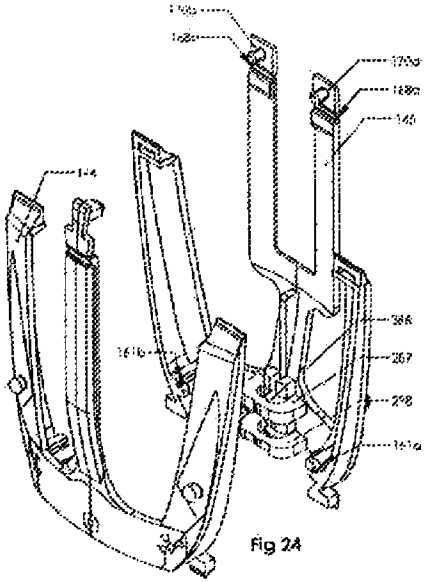
FIG. 24 is another perspective view showing the second subportion and third subportion of the lower body piece of FIG. 11, showing the second and third subportions removed.
Figure 26:
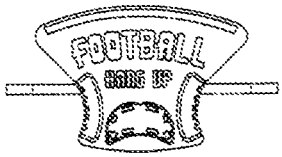
FIG. 26 is a bottom view of the object retention member of the device of FIG. 1A.
Figure 25:
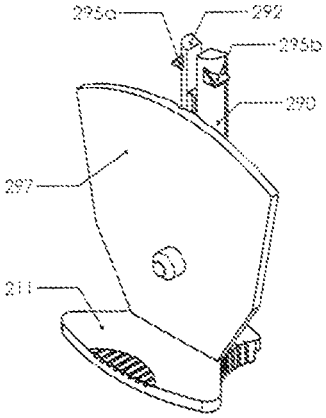
FIG. 25 is a perspective view of the object retention member of the device of FIG. 1A.
Figure 27:
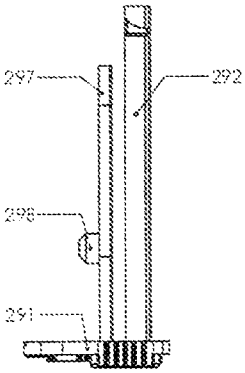
FIG. 27 is a side view of the object retention member of the device of FIG. 1A.
Figure 28:
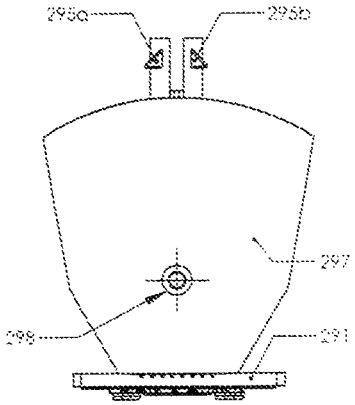
FIG. 28 is a front view of the object retention member of the device of FIG. 1A.
Figure 29:
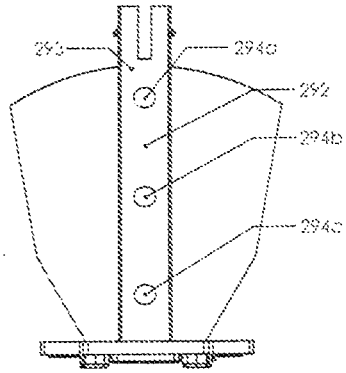
FIG. 29 is a rear view of the object retention member of the device of FIG. 1A.
Figure 30:
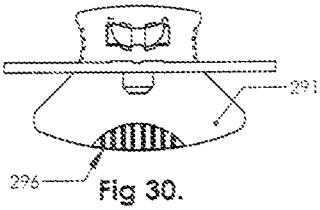
FIG. 30 is a top view of the object retention member of the device of FIG. 1A.
Figure 31:
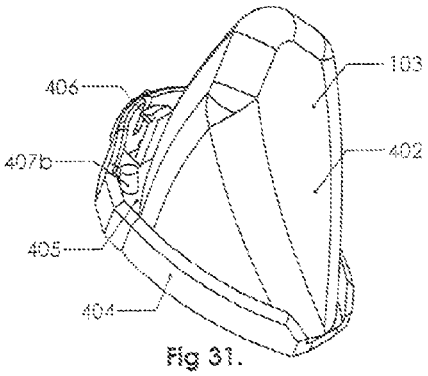
FIG. 31 is a perspective view of an arm cap of the device of FIG. 1A.
Figure 32:
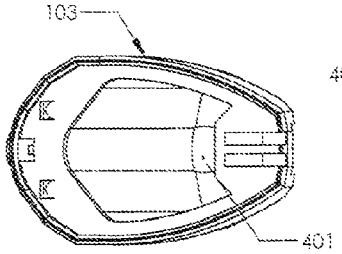
FIG. 32 is a bottom view of an arm cap of the device of FIG. 1A.
Figure 33:
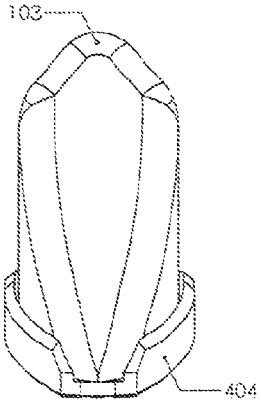
FIG. 33 is a side view of an arm cap of the device of FIG. 1A.
Figure 34:
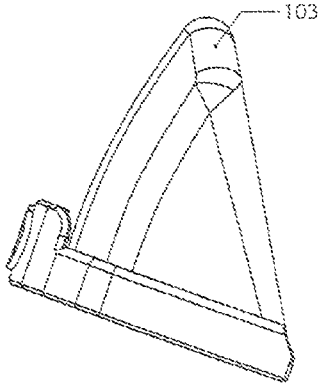
FIG. 34 is a front view of an arm cap of the device of FIG. 1A.
Figure 35:
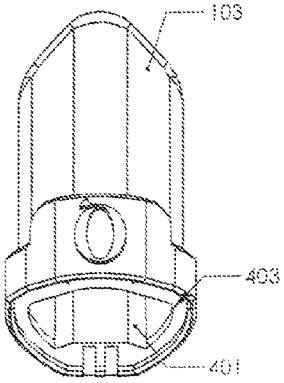
FIG. 35 is a side view of an arm cap of the device of FIG. 1A.
Figure 36:
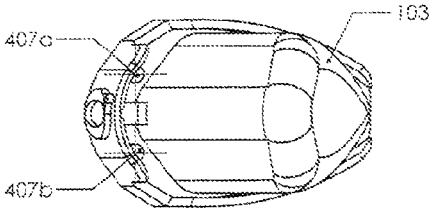
FIG. 36 is a top view of an arm cap of the device of FIG. 1A.

As shown in FIGS. 22 and 24, subportion 145 of lower body piece 102 has a track feature 287 into which object retention member 290 is inserted. Track feature 287 has a plurality of walls that define a channel 298. Track feature 285 also has a recess 286 for receiving a ball spring mounted ball bearing (not shown) is located in the back wall of track feature 287.

FIGS. 25-30 show details of object retention member 290. Object retention member 290 has a generally flat base 291 portion extending outward at approximately ninety degrees from axis of a slide portion 292. Slide portion 292 has a cross section shaped to correspond to the channel 298 in lower body piece 102. When the object retention member 290 is assembled to the lower body piece 102, the slide portion 292 resides in and slides up and down in channel 298. Slide portion 292 has a back surface 293 which has dimples 294*a*, 294*b* and 294*c*. Dimples 294*a*, 294*b* and 294*c* act as detents in which the ball bearing in lower body piece 102 rests to create three stop positions for the object retention member, corresponding to the three dimples. The interface of the spring loaded ball bearing provides sufficient force to prevent the object retention member from sliding downward under the weight of the retained object. Slide portion 292 also has stops 295*a* and 295*b* protruding therefrom at an end opposite the base portion 291. The stops 295*a* and 295*b* flush the top of the track feature 285, thereby preventing the object retention member from being pulled downward all the way out of the channel 298.

Base 291 is generally sized to cover most of the opening 111, thereby preventing objects stored in the compartment from falling out. Base 291 may also have a grip feature 296 formed therein to allow a user to grip the base 291 to pull down the object retention member and access the object in the compartment.

Object retention member 290 further has a backer 297, which further supports the stored object. In the embodiment of object retention member 290, an object locator, shown as protrusion 298, is employed to further secure the retained object, which has a hole corresponding to the size and shape of protrusion 298. For example, in one embodiment, the retained object may be a fragrance emitter, that has a hole such that the fragrance emitter can be mounted over protrusion 298 and retained to the object retention member 290.

Object retention member 290 may be injection molded and made from 30% glass filled nylon or other suitably strong material.

FIGS. 31-36 show details of arm caps 103*a* and 103*b*, which are identical. Arm caps 103*a* and 103*b* have a concave surface 401 and a convex surface 402 and an arm cap base 403. (The convex surface does not necessarily follow a regular curve). A lip 404 extends upward from the arm cap base 403, which forms a channel 405 between the lip and the convex surface 402. An arm cap mating feature 406 extends upward from the channel 405. As shown in this embodiment, the arm cap mating feature is a snap fit cantilever beam. This embodiment also has a pair of alignment pins 407*a* and 407*b*.

During assembly, after the cover 104 has been applied and the lower body piece 102 has been assembled, arm caps 103*a*, and 103*b* are attached to the upper body piece 101. As the arm cap 103 is attached to the shoulder extension 122, the end of the sleeve portion of the cover 104 is tucked into the channel 405. The end of the shoulder extension 122 also slides into channel 405, thereby securing the cover 104 in a compression fit between the lip and the exterior surface 17 of shoulder extension 122.

When assembled, the convex surface 402 of the arm cap also abuts the interior surface 16 of the shoulder extension 122 on one side. On the opposite side of the convex surface 402 of the arm cap, the arm cap 103 is laterally supported by the outer edge 125 of the side extension 126. The cover 104 is retained between the arm and the outer edge 125 of the side extension 126. The convex surface further provides support and structure for the sleeve portion of the cover 104.

During assembly, the arm cap mating feature 406, snaps into shoulder extension mating member 123 thereby retaining the arm cap 103 to the shoulder extension 122. During the attachment, alignment pins 407*a* and 407*b* may also slide into guide pin holes 124*a* and 124*b*, respectively, to assist in alignment of the arm caps to the upper body piece. Alignment pins may also be tapered to assist in alignment. In one embodiment, the arm caps are molded HDPE, however, other suitable materials as would be recognized by one of ordinary skill in the art may be used.

FIGS. 37-42 show details of an embodiment of an attachment device 105. Attachment device 105 is a combination clip/carabineer and suction cup. This embodiment allows a user to attach the device 100 either to a sufficiently smooth surface, such as glass, via the suction cup, or to any clipable item such as a bag handle, hook, bar, strap, etc. via the clip. Attachment device 105 has four components: suction cup 701, clip base 702, clip arm 704 and springs 703*a* and 703*b*. Suction cup 701 has a suction portion 705 for suctioning to flat surfaces and an extension portion 706 extending from the suction portion for mating with clip base 702. Clip base 702 has first opening 707 for receiving the extension portion 706 of the suction cup 701 in a snap fit configuration. As shown in FIG. 40, clip base 702 has a clip portion 709 from which a suction cup receiving member extends. The first opening 707 is positioned on the suction cup receiving member so that the suction cup is offset from the clip portion 709 of clip base 702. The clip suction cup receiving member has a channel 708, which is sized to receive the width of packaging header (described in detail below) when the device is in the packaging.

Figure 43B:
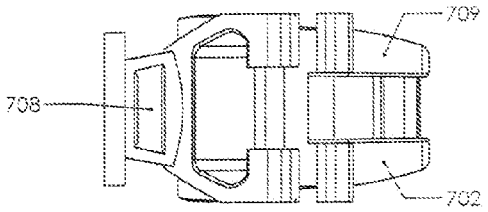
FIG. 43B is a bottom view of the clip base of the attachment device of FIG. 37.
Figure 43C:
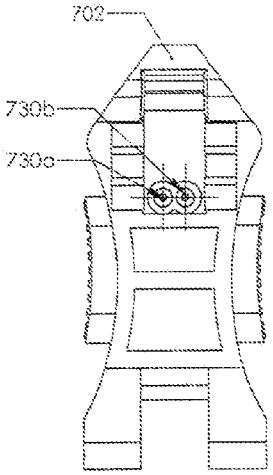
FIG. 43C is a front view of the clip base of the attachment device of FIG. 37.
Figure 43D:
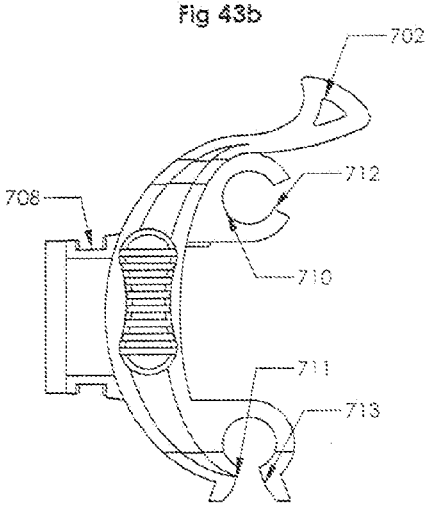
FIG. 43D is a side view of the clip base of the attachment device of FIG. 37.
Figure 43E:
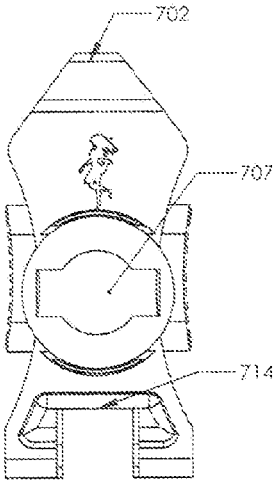
FIG. 43E is a rear view of the clip base of the attachment device of FIG. 37.
Figure 43F:
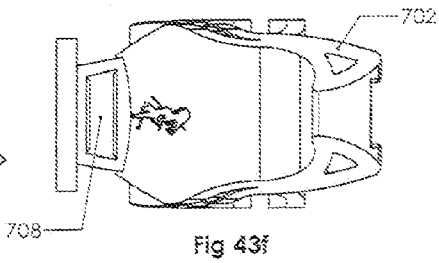
FIG. 43F is a top view of the clip base of the attachment device of FIG. 37.
Figure 43A:
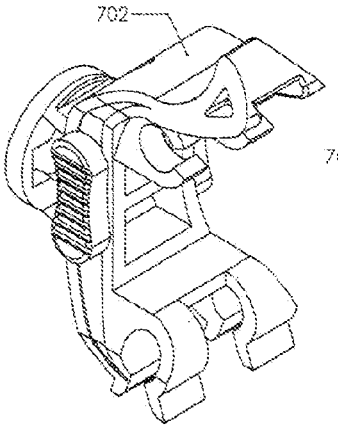
FIG. 43A is a perspective view of the clip base of the attachment device of FIG. 37.
Figure 44B:
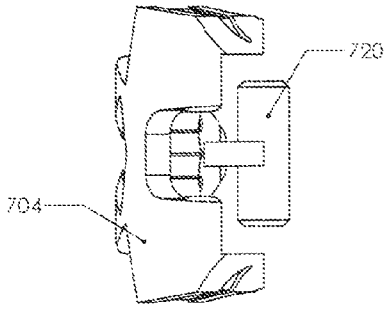
FIG. 44B is a bottom view of the clip arm of the attachment device of FIG. 37.
Figure 44C:
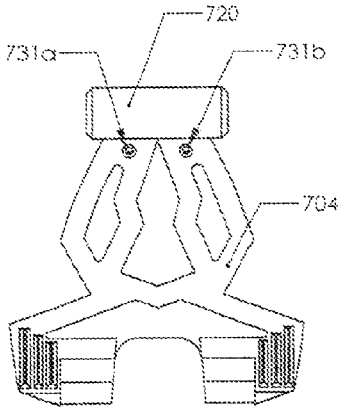
FIG. 44C is a front view of the clip arm of the attachment device of FIG. 37.
Figure 44D:
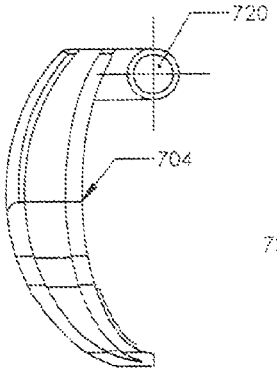
FIG. 44D is a side view of the clip arm of the attachment device of FIG. 37.
Figure 44E:
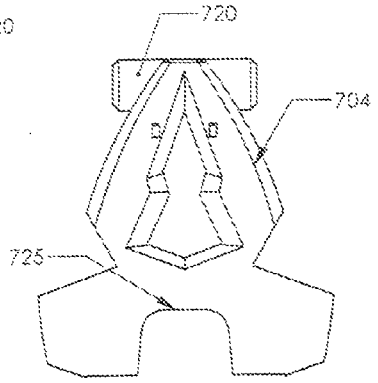
FIG. 44E is a rear view of the clip arm of the attachment device of FIG. 37.
Figure 44F:
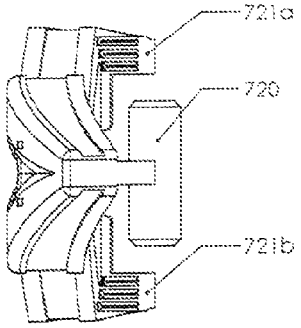
FIG. 44F is a top view of the clip arm of the attachment device of FIG. 37.
Figure 44A:
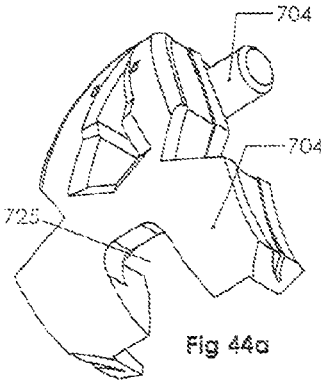
FIG. 44A is a perspective view of the clip arm of the attachment device of FIG. 37.
Figure 47:
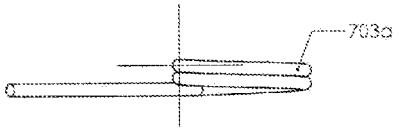
FIG. 47 is a bottom view of the spring of FIG. 45.
Figure 45:
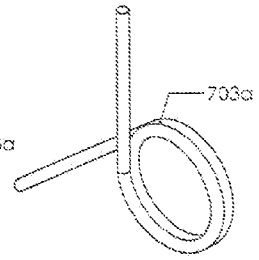
FIG. 45 is a perspective view of an embodiment of a first spring of the attachment device of FIG. 37.
Figure 46:
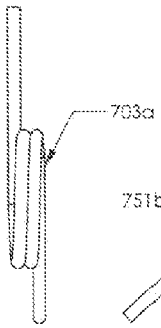
FIG. 46 is a side view of the spring of FIG. 45.
Figure 48:
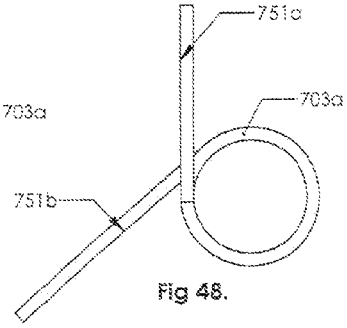
FIG. 48 is a front view of the spring of FIG. 45.
Figure 50:
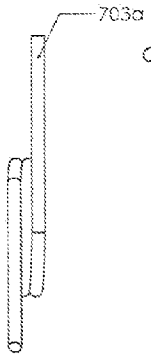
FIG. 50 is a side view of the spring of FIG. 45.
Figure 49:
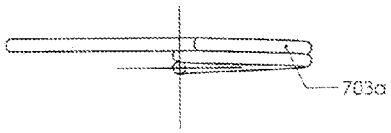
FIG. 49 is a top view of the spring of FIG. 45.
Figure 53:
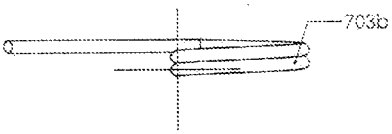
FIG. 53 is a bottom view of the spring of FIG. 51.
Figure 51:
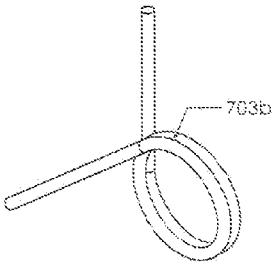
FIG. 51 is a perspective view of an embodiment of a second spring of the attachment device of FIG. 37.
Figure 52:
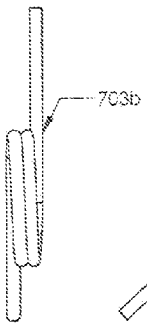
FIG. 52 is a side view of the spring of FIG. 51.
Figure 54:
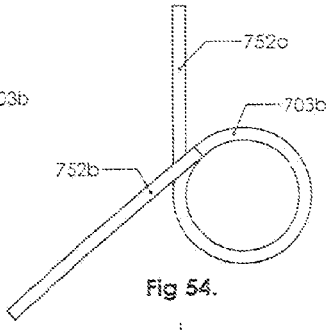
FIG. 54 is a front view of the spring of FIG. 51.
Figure 56:
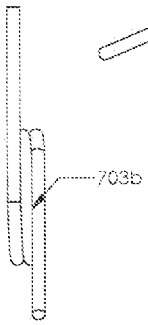
FIG. 56 is a side view of the spring of FIG. 51.
Figure 55:
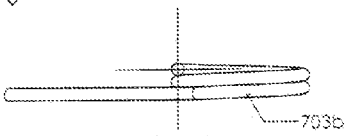
FIG. 55 is a top view of the spring of FIG. 51.

FIGS. 43A-43F show details of the clip base 702. Clip base 702 further has a first cylindrical channel 710. As shown in FIG. 43D, in this embodiment, the first cylindrical channel 710 is near the top of the clip base 702 and has a horizontal axis. First cylindrical channel further has an open side 712. Clip base 702 also has a second cylindrical channel 711, which, in this embodiment, is at the bottom of the clip base 702 and also has a horizontal axis. The second cylindrical channel 711 also has an open side 713. The axes of the first cylindrical channel 710 and the second cylindrical channel 711 may be coplanar in certain embodiments, as shown.

The second cylindrical channel 711 rotatably receives the pivot pin 117 on the upper body piece 101 to rotatably attach the attachment device 105 to the upper body piece 101. Clip base 702 further has a slot 714 that intersects and extends through the second cylindrical channel 711. Slot 714 corresponds to upper body piece connector 118 to permit the attachment device 105 to rotate relative to upper body piece 101.

Clip base 702 also has a pair of spring receiving holes 730*a* and 730*b* proximate the first cylindrical channel 710 into which one of the ends of springs 703*a* and 703*b* (shown in FIGS. 45-56), respectively, are inserted. Springs 703*a* and 703*b* are torsion springs. Spring 703*a* has opposed arms 751*a* and 751*b* extending from a coil. Similarly, spring 703*b* has opposed arms 752*a* and 752*b* extending from a coil. Arms 751*a* and 751*b* (and 752*a* and 752*b* of spring 703*b*) are approximately 140 degrees opposed from one another in the free position. Springs 703*a* and 703*b* may be made of stainless steel. It is contemplated that in an alternative embodiment, a single spring could be used.

FIGS. 44A-44F show details of clip arm 704. Clip arm 704 has a cylindrical pivot pin 720. As shown in the embodiment in FIGS. 44A-44F. Cylindrical pivot pin 720 is at the top of the clip arm. Cylindrical pivot pin 720 rotatably connects to first cylindrical channel 710 to rotatably connect clip arm 704 to clip base 702.

Clip arm 704 also has a pair of spring receiving holes 731*a* and 731*b* proximate the first cylindrical channel 710 into which other ends of springs 703*a* and 703*b* are inserted. The springs 703 bias the clip arm 704 into a closed position.

Clip arm 704 further has a pair of security members 721*a* and 721*b* at the base of the clip arm 704. When the clip arm 704 is in the closed position, security members 721*a* and 721*b* extend over at least a portion of the opening of the second cylindrical channel 711 and the pivot pin 117 on the upper body piece 101, thereby further retaining, or locking, the pivot pin 117 to the attachment device.

Clip arm 704 also has a slot 725 positioned proximate the security members 721*a* and 721*b*. Slot 725 corresponds to upper body piece connector 118 to permit the attachment device 105 to rotate relative to upper body piece 101.

FIGS. 42A-C illustrate the freedom of rotation of the attachment device 105 relative to the upper body piece 101. FIG. 42A shows the attachment device in a horizontal back-facing orientation, such that the suction cup 701 can attach to a vertical surface, allowing the upper body piece to hang vertically. In this configuration, the clip can attach to a horizontal clipable object. FIG. 42B shows the attachment device 105 in a horizontal front facing orientation, such that the suction cup 701 can attach to a vertical surface, allowing the upper body piece 101 to hang vertically. To place the device in this configuration from the configuration in FIG. 42*a*, the attachment device 105 is removed from the upper body piece 101, rotated 180 degrees and reattached to the upper body piece 101. FIG. 42C shows the attachment device 105 in a vertical orientation, such that the suction cup 701 can attach to a horizontal surface, allowing the upper body piece 101 to hang vertically. It will be appreciated that the ability of the attachment device to rotate relative to the upper body piece 101 allows the suction cup 701 to be attached to surfaces that are angled between a horizontal and vertical orientation while allowing the upper body piece 101 to hang vertically.

Figures 57, 58, 59A, 59B:
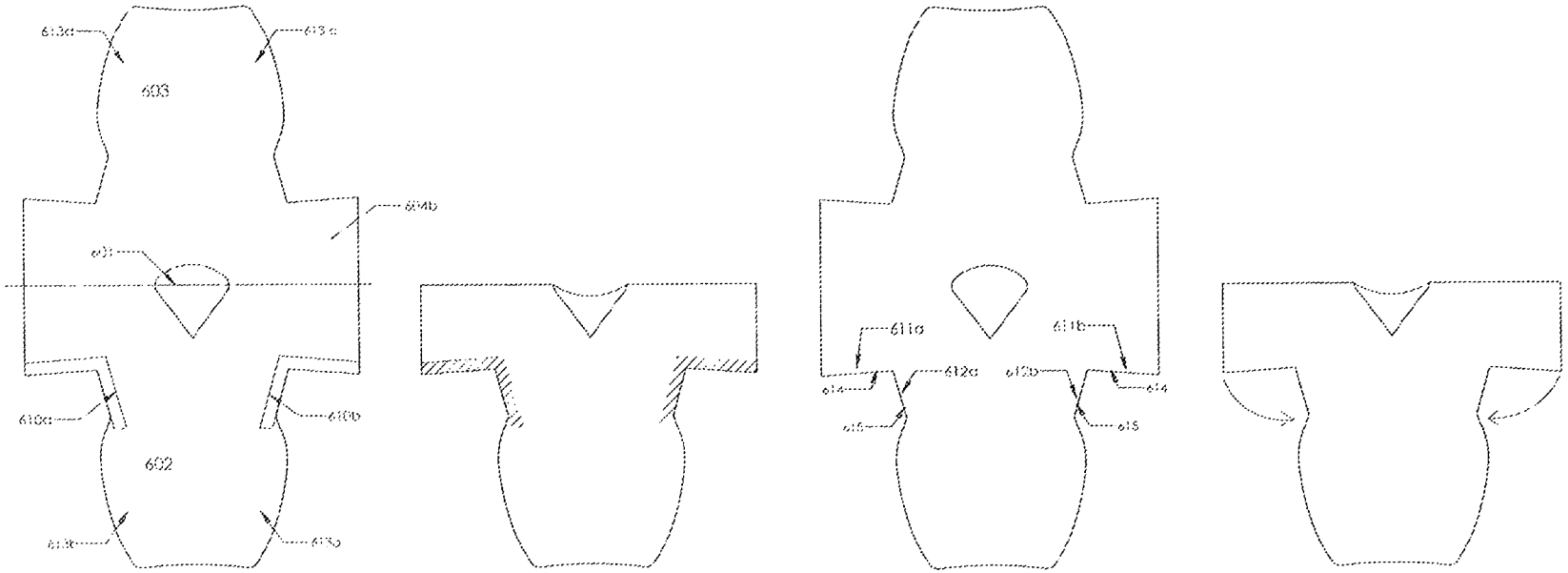
FIG. 57 is a top view of an unfolded and unassembled cover of the device of FIG. 1A.
FIG. 58 is a top view of an unfolded and unassembled cover of FIG. 57.
FIG. 59A is a top view of the cover of FIG. 57, partially assembled (folded).
FIG. 59B is a top view of the cover of FIG. 57, further assembled (folded into the arms).

FIGS. 57-59B show the manufacture of one embodiment of the cover 104. As shown in FIG. 57, cover 104, when in an unassembled state, is a planar piece of fabric having opening 601, which corresponds as the neck hole of the jersey. During assembly, the cover 104 is folded along center line such that front 602 is aligned with overlaps back 603. Then, as shown in FIG. 59*a*, the front portion 602 of the cover is attached to the back portion 603 of the cover at the sleeve portions 604*a* and 604*b* at attachment areas 610*a* and 610*b*. In one embodiment, the attachment is a sonic weld. Then, as shown in FIGS. 58 and 59B, attachment areas 611*a* and 611*b*, corresponding to the sleeve, are attached to attachment areas 612*a* and 612*b*, thereby securing the sleeves to the sides of the jersey. Again, this attachment may be sonic weld, which provides for reliable and fast assembly. However, it is contemplated that other attachment methods including sewing or adhesive attachment may be used.

FIGS. 60-66 show the packaging for the device 100 and the interface of the packaging and the device itself. The interface of the packaging to the device enhances the presentation of the device to potential buyers. In particular, as described in more details below, the interface of the attachment device 105 to the packaging header presents the device to the user as it would be displayed when the device is hung from its attachment device in actual use.

Figure 60:
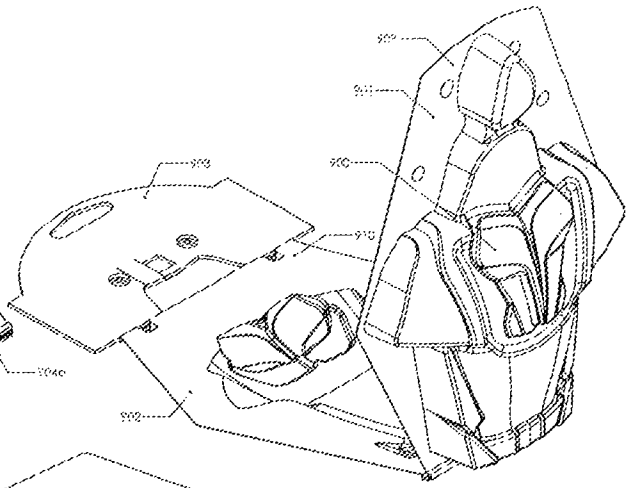
FIG. 60 is a perspective view of an embodiment of the packaging for the device of FIG. 1A.
Figure 61:
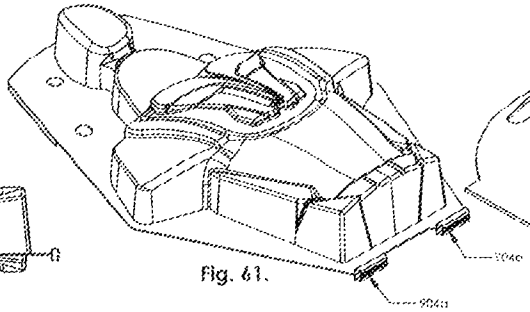
FIG. 61 is a perspective view of the clamshell portion of the packaging of FIG. 60.
Figure 62:
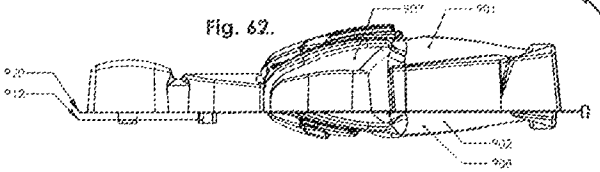
FIG. 62 is a side view of the clamshell portion of the packaging of FIG. 60.
Figure 66:
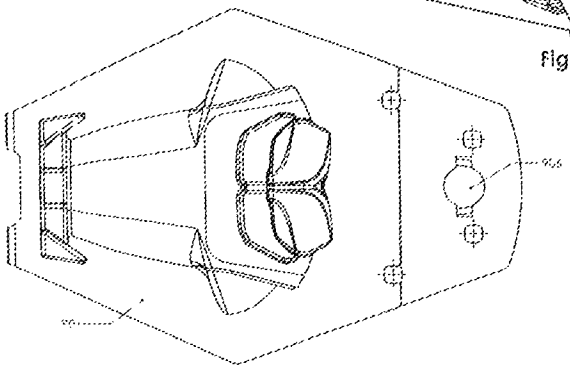
FIG. 66 is a rear view of the clamshell portion of the packaging of FIG. 60.
Figure 65:
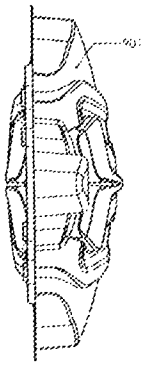
FIG. 65 is a top view of the clamshell portion of the packaging of FIG. 60.
Figure 64:
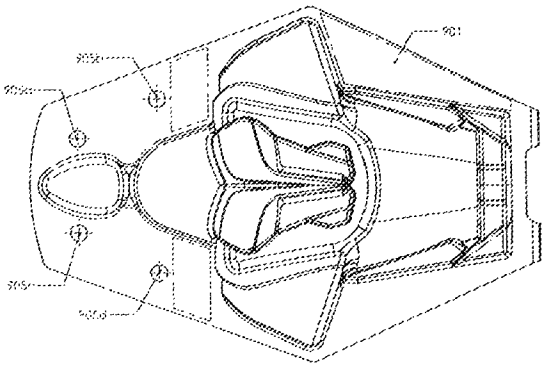
FIG. 64 is a front view of the clamshell portion of the packaging of FIG. 60.
Figure 63:
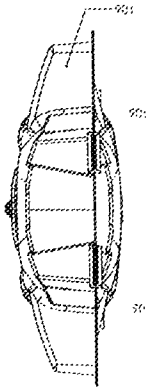
FIG. 63 is a bottom view of the clamshell portion of the packaging of FIG. 60.

As shown in FIGS. 60 and 67-69, the packaging has a clamshell 901 and a header portion 903. Details of clam shell 900 are shown in FIGS. 60 66. Clamshell 900 has a front side 901 and a back side 902. The front side 901 and back side 902 each have contoured portions 907 and 908, respectively to match the form of the device 100. The front side has a flat portion 909 and the back side has a second portion 910. The first flat portion and the second flat portion extend outward from and circumscribe the contoured portions 907 and 908. When the clamshell is closed, the first flat portion and the second flat portion abut one another and lie in coplanar, adjacent planes. The back side 902 also has a third flat portion 912 near the top of the packaging, that is parallel to but not coplanar with the first and second flat portions 909 and 910. When the clamshell is closed, a space exists between the first flat portion 909 and the third flat portion 912.

Header 903 is positioned adjacent the third flat portion and in the space between the first and third flat portions. The third flat portion 912 on the backside also has an opening 906, therein.

At least the contoured portions 907 and 908 are preferably transparent to allow potential buyers to see the device through the packaging. The front side 901 and back side 902 are connected to one another via a pair of hinges 904*a* and 904*b*. Hinges 904*a* and 904*b* are positioned at the bottom of the packaging. Front and back portions of the clamshell have corresponding press fit features 905*a*, 905*b*, 905*c* and 905*d* to secure the front portion and back portion closed.

Header 903 has a cutout 911 and a tab 910, which is defined by two parallel cuts extending from an edge of the header. One side of the opening is defined by an edge of the tab 910. The header further has a pair of cutouts 913 and 914, which correspond to press fit features to align the header to the clamshell. When aligned, the cutout 911 in the header aligns with opening 906 in the back side 902 of the clamshell. When the device is packaged into the packaging, tab 910 is folded to create an opening next to the cutout 911 and suction cup receiving member channel 708 is positioned into the cutout 911.

Figure 67:
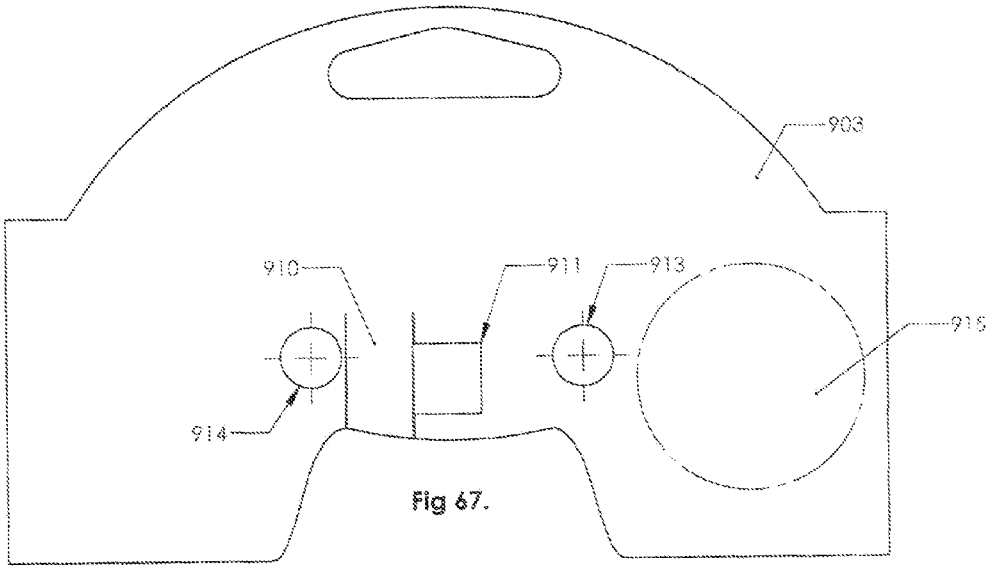
FIG. 67 is a front view of the header portion of the packaging of FIG. 60.
Figure 68:
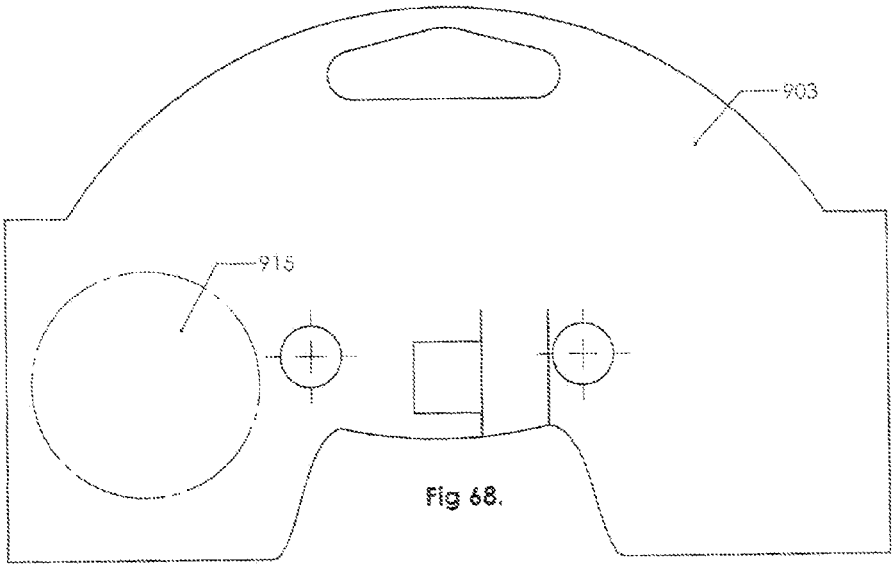
FIG. 68 is a rear view of the header portion of the packaging of FIG. 60.

Suction cup 701 is pushed through opening 906, so that suction cup 701, or at least a part thereof, extends out of the back of the packaging. The tab is then folded down to securely retain the suction cup receiving member 708. The cutout 911 is sized to the approximate size of the cross section of the suction cup receiving member at the portion of the suction cup receiving member that intersects the cutout, thereby securely retaining the device within the cutout 911 and allowing only minimal movement between header and the suction cup receiving member. In this manner, the product is displayed to a consumer in the packaging in a similar manner to how it would be displayed when in use. In one embodiment, as shown in FIGS. 67 and 68, the header 903 includes a perforated cutout 915, matching the shape of head portion of the upper body piece 101. The perforated cutout may bear a graphic, for example a football helmet. The perforated cutout may be "punched" out along the perforation by a user and attached to the head portion to alter the appearance of the device.

Additional detail including drawings and written description of components and alternative embodiments are disclosed in the attached drawings that follow. While one or more specific embodiments have been illustrated and described in connection with the invention(s), it is understood that the invention(s) should not be limited to any single embodiment, but rather construed in breadth and scope in accordance with the appended claims.

I claim:

1. A torso shaped storage device comprising:

a plastic frame portion comprising an upper body piece;

a lower body piece attached to the upper body piece, the lower body piece having a first portion having a first pair of opposed surfaces, a second portion having a second pair of opposed surfaces, and a first hinge rotatably connecting the first portion to the second portion; and a compartment formed by the first portion and the second portion; and a cover, covering at least part of the upper body piece and lower body piece, wherein the cover is retained to the frame portion between the first pair of opposed surfaces of the first portion of the lower body piece and between the second pair of opposed surfaces of the second portion of the lower body piece.

2. The device of claim 1, wherein the first portion is rotatable at the first hinge away from the second portion such that rotation of the first portion away from the second portion opens the compartment and rotation of the first portion towards the second portion closes the compartment.

3. The device of claim 2, having a first magnet attached to the first portion of the lower body piece and a second magnet attached to the second portion of the lower body piece, wherein the magnets bias the device to a closed position.

4. The device of claim 1, wherein the upper body piece forms a shoulder portion of the torso shaped device and the lower body piece forms a lower portion of the torso shaped device.

5. The device of claim 1, having a base defining an opening, wherein the opening in the base provides access to the compartment.

6. The device of claim 5 further comprising an object retention member slidably connected to the frame portion, the object retention member having a slide portion and a base portion extending from the slide portion, wherein the object retention member is slidable between a first position in which the base portion is positioned proximate the base of the device and a second position in which the base portion is positioned further away from the base of the device.

7. The device of claim 5 further comprising:

a cover opening opposite the base; and an attachment device comprising a carabineer clip and a suction cup non-rotatably attached to the clip, wherein the clip and the suction cup are rotatably attached to the frame portion such that the suction cup can be aligned with the front or the back of the device.

8. The device of claim 1, the first portion of the lower body piece comprising a first subportion; a second subportion; a first connection comprising a second hinge hingedly connecting the first subportion to the second subportion; and a second connection non-rotatably connecting the first subportion to the second subportion; and the second portion of the lower body piece comprising a third subportion; a fourth subportion; a third connection comprising a third hinge hingedly connecting the third subportion to the fourth subportion; and a fourth connection non-rotatably connecting the third subportion to the fourth subportion.

9. The device of claim 8, wherein the cover is retained between the first subportion and the second subportion and the cover is retained between the third subportion and the fourth subportion.

10. The device of claim 8, the first subportion having a first elongate attachment member directly attached to the upper body piece and the third subportion having a second elongate attachment member directly attached to the upper body piece.

11. The device of claim 1 further comprising:

a first arm cap connected to the upper body piece, the first arm cap having a channel wherein a first sleeve portion of the cover is retained; and a second arm cap connected to the upper body piece, the second arm cap having a channel wherein a second sleeve portion of the cover is retained.

12. The device of claim 11, wherein the first arm cap and the second arm cap retain the cover between the first arm cap and the upper body piece and between the second arm cap and the upper body piece.

13. The device of claim 1, having:

a first arm cap connected to the upper body piece, a first concave surface on the first arm cap;

a first convex surface on the first arm cap, opposite the first concave surface;

a second arm cap connected to the upper body piece;

a second concave surface on the second arm cap;

a second convex surface on the second arm cap, opposite the first convex surface;

a first sleeve on the cover; and a second sleeve on the cover;

wherein the first convex surface supports at least a portion of the first sleeve, and the second convex surface supports at least a portion of the second sleeve.

14. A torso shaped storage device comprising:

a torso shaped plastic frame portion;

a cover covering at least part of the frame portion, the cover having a first sleeve portion and a second sleeve portion;

a compartment inside of the frame portion;

a base having an opening;

an attachment device configured for hanging the storage device;

a first arm cap connected to the frame portion, the first arm cap having a first concave surface and a first convex surface opposite the first concave surface; and a second arm cap connected to the frame portion, the second arm cap having a second concave surface and a second convex surface, opposite the first convex surface;

wherein the first convex surface supports at least a portion of the first sleeve portion, and the second convex surface supports at least a portion of the second sleeve portion.

15. A torso shaped storage device comprising:

a frame portion comprising an upper body piece;

a lower body piece attached to the upper body piece, the lower body piece comprising:

a first subportion;

a second subportion adjacent the first subportion;

a third subportion adjacent the second subportion;

a fourth subportion adjacent the third subportion;

a first hinge rotatably connecting the first subportion to the second subportion;

a first mating feature on the first subportion and a corresponding second mating feature on the second subportion, wherein the first mating feature and the second mating feature are connected to prevent rotation of the first subportion relative to the second subportion and to retain the cover between the first subportion and the second subportion;

a second hinge rotatably connecting the second subportion to the third subportion; and a third hinge rotatably connecting the third subportion to the fourth subportion; and a third mating feature on the third subportion and a corresponding fourth mating feature on the fourth subportion, wherein the third mating feature and the fourth mating feature are connected to prevent rotation of the third subportion relative to the fourth subportion and to retain the cover between the third subportion and the fourth subportion;

a cover covering at least part of the upper body piece and lower body piece.

* * * * *